US005651725A

United States Patent [19]

Kikuta et al.

[11] Patent Number: 5,651,725

[45] Date of Patent: Jul. 29, 1997

[54] APPARATUS AND METHOD FOR POLISHING WORKPIECE

[75] Inventors: Ritsuo Kikuta, Ichikawa; You Ishii, Fujisawa; Tamami Takahashi, Yamato, all of Japan

[73] Assignee: Ebara Corporation, Tokyo, Japan

[21] Appl. No.: 628,990

[22] Filed: Apr. 10, 1996

[30] Foreign Application Priority Data

Apr. 10, 1995 [JP] Japan ..... 7-108973

[51] Int. Cl.[6] ..... B24B 1/00; B24B 7/19; B24B 7/30

[52] U.S. Cl. ..... 451/41; 457/285; 457/286; 457/287; 457/288; 457/444; 457/57

[58] Field of Search ..... 457/285–290, 457/443, 41, 60, 57, 447, 446, 28

[56] References Cited

U.S. PATENT DOCUMENTS 5,384,986 1/1995 Hirose et al. ..... 451/444

5,456,327 10/1995 Jackson et al. ..... 451/57

5,486,131 1/1996 Cesna et al. ..... 451/444

5,536,202 7/1996 Appel et al. ..... 451/285

*Primary Examiner*—Robert A. Rose

*Assistant Examiner*—George Nguyen

*Attorney, Agent, or Firm*—Wenderoth, Lind & Ponack

[57] ABSTRACT

An apparatus and method for polishing a workpiece such as a semiconductor wafer to a flat mirror finish. The workpiece is held by a top ring, and a surface of the workpiece is polished by pressing the workpiece against an abrasive cloth mounted on a turntable while applying an abrasive solution onto the abrasive cloth. While the workpiece is being polished, a surface of the abrasive cloth is dressed while applying a dressing liquid onto the abrasive cloth. A polishing operation and a dressing operation are performed in such a state that the abrasive solution and the dressing liquid do not interfere with each other.

7 Claims, 1 Drawing Sheet

APPARATUS AND METHOD FOR POLISHING WORKPIECE

BACKGROUND OF THE INVENTION

1. Field of the Invention

The present invention relates to an apparatus and method for polishing a workpiece, and more particularly to an apparatus and method for polishing a workpiece such as a semiconductor wafer to a flat mirror finish.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 μm wide, it requires that surfaces on which pattern images are to be focused on by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus.

Conventionally, a polishing apparatus has a turntable and a top ring which rotate at respective individual speeds. An abrasive cloth is attached to the upper surface of the turntable. A semiconductor wafer to be polished is placed on the abrasive cloth and clamped between the top ring and the turntable. An abrasive solution containing abrasive grains is supplied onto the abrasive cloth and retained on the abrasive cloth. During operation, the top ring exerts a certain pressure on the turntable, and the surface of the semiconductor wafer held against the abrasive cloth is therefore polished to a flat mirror finish while the top ring and the turntable are rotating.

After polishing, the used abrasive solution containing abrasive grains, ground-off particles of the semiconductor wafer and the like remain on the abrasive cloth mounted on the turntable. Further, after polishing, a surface condition of the abrasive cloth is deteriorated by the polishing operation. As a result, a polishing rate is not constant throughout the whole polishing time, and the change in the polishing rate occurs on the polishing surface of the abrasive cloth, resulting in a failure to accomplish a desired degree of flatness of the polished surface of the semiconductor wafer and shortening a service life of the abrasive cloth.

A change in polishing characteristics of the abrasive cloth with time depends on material for the abrasive cloth, a surface configuration of the abrasive cloth, the type of abrasive solution to be used, or a combination thereof. For example, in case of abrasive cloth comprising nonwoven fabric composed of fibers bound together by urethane resin, the property of the surface of the cloth changes with the polishing operation. In case of abrasive cloth comprising polyurethane foam, micropores in its surface are clogged with abrasive grains, and dulling or glazing occurs in micropores in its surface. As a result, the retaining condition of the abrasive solution or the abrasive grains changes, and hence the polishing characteristics of the abrasive cloth changes. Further, the polishing action is affected by various factors including grain sizes of abrasive grains, the degree of intensity of abrasive solution in chemical etching action and the like.

In order to eliminate the above difficulties or disadvantages, after a polishing operation finishes once, a certain treatment is applied to the abrasive cloth to regenerate the abrasive cloth. This treatment is called a dressing of the abrasive cloth. The object of the dressing is to remove the abrasive solution containing abrasive grains and ground-off particles of the semiconductor wafer and to restore a surface condition of the abrasive cloth. The dressing is carried out after polishing a preceding semiconductor wafer and before polishing a subsequent semiconductor wafer.

Conventionally, the dressing is carried out to remove the abrasive solution and ground-off particles of the semiconductor wafer and to regenerate the abrasive cloth by scrubbing the abrasive cloth with a brush while supplying a dressing liquid such as water onto the abrasive cloth. Alternatively, the dressing is carried out by pressing a dressing tool having diamond grains on its lower surface against the abrasive cloth while supplying a dressing liquid such as water. The above dressing methods can be used properly depending on the types of abrasive cloth.

However, the used abrasive solution and ground-off particles of the semiconductor wafer are being accumulated while a polishing operation is carried out. Further, the abrasive cloth is being deteriorated throughout the whole polishing time. Therefore, the polishing action by the abrasive cloth is being weakened in the course of a polishing operation.

Further, since the dressing must be performed in between polishing operations, the polishing operation cannot be continuously performed, thus lowering the throughput of the semiconductor wafers.

SUMMARY OF THE INVENTION

It is therefore an object of the present invention to provide an apparatus and method for polishing a workpiece which can polish a workpiece such as a semiconductor wafer in a good polishing condition throughout the whole polishing time.

According to a first aspect of the present invention, there is provided an apparatus for polishing a workpiece comprising: a turntable with an abrasive cloth mounted on an upper surface thereof; a top ring disposed above said turntable and having a holding surface for holding a workpiece to be polished and pressing the workpiece against said abrasive cloth; a dressing head for dressing said abrasive cloth provided at a location away from said top ring; a partition wall for partitioning a surface of said abrasive cloth into a polishing area in which said top ring is operated and a dressing area in which said dressing head is operated; a nozzle for supplying an abrasive solution onto said polishing area on said abrasive cloth; and a nozzle for supplying a dressing liquid onto said dressing area on said abrasive cloth.

According to a second aspect of the present invention, there is provided a method for polishing a workpiece, comprising the steps of: holding a workpiece by a top ring; polishing a surface of the workpiece by pressing the workpiece against an abrasive cloth mounted on a turntable while applying an abrasive solution onto said abrasive cloth; and dressing a surface of said abrasive cloth while applying a dressing liquid onto said abrasive cloth during polishing in such a state that the abrasive solution and the dressing liquid do not interfere with each other.

According to the present invention, since the abrasive cloth is dressed to remove the used abrasive solution and the ground-off particles of the workpiece and to regenerate the abrasive cloth during polishing, the workpiece can be polished in a good polishing condition throughout the whole polishing time.

Further, the workpieces can be continuously polished without a dressing operation in between polishing operations, thus increasing the throughput of the workpieces.

Furthermore, since a partition wall is provided to partition a surface of the abrasive cloth into a polishing area and a dressing area, the abrasive solution for use in polishing and the dressing liquid for use in dressing are not mixed with each other. Thus, the polishing action of the abrasive solution is not weakened, and the effect of dressing for washing away the abrasive solution from the abrasive cloth is not lowered.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENTS

Figure 1:
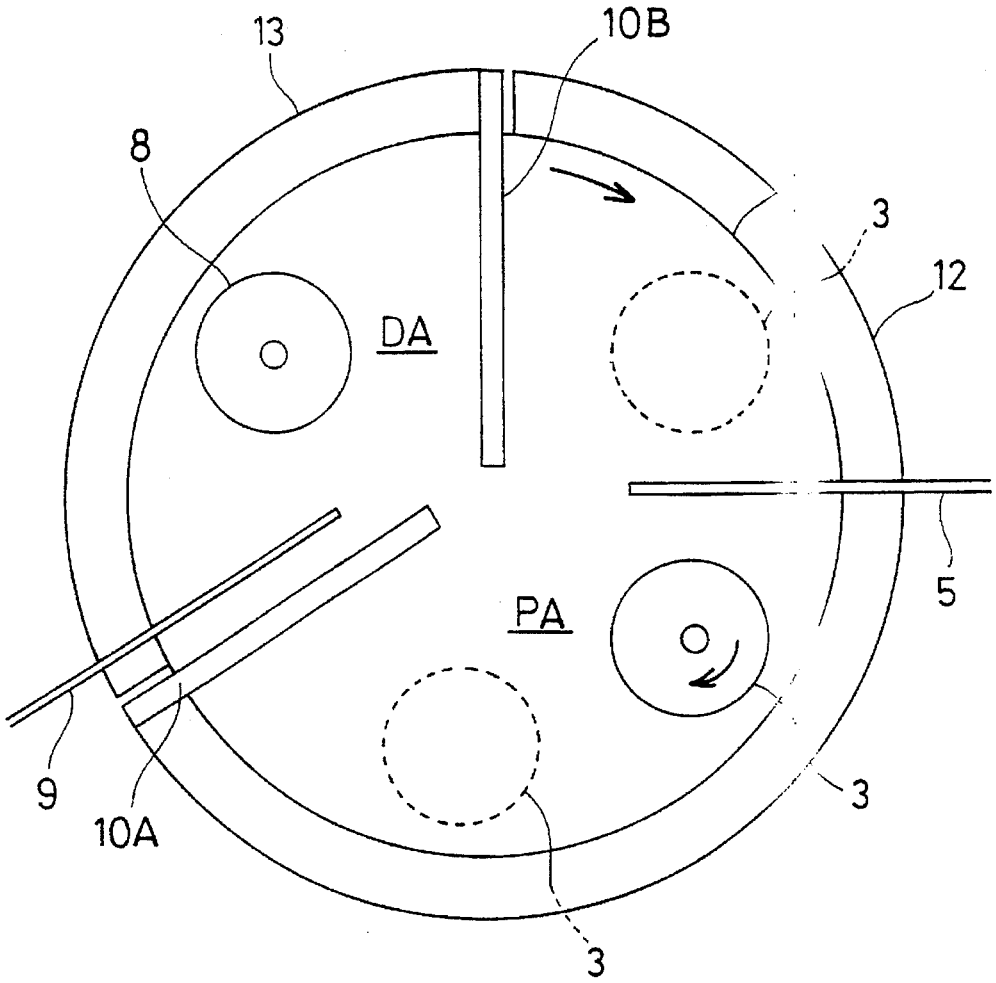
FIG. 1 is a plan view of a polishing apparatus according to an embodiment of the present invention.
Figure 2:
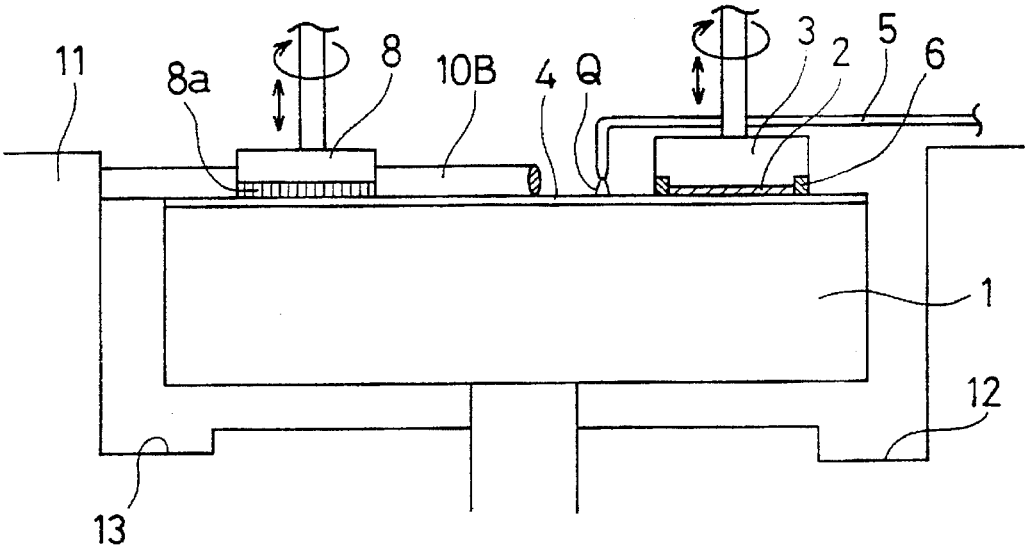
FIG. 2 is a vertical cross-sectional view of the polishing apparatus according to the embodiment of the present invention.

A polishing apparatus according to an embodiment of the present invention will be described below with reference to FIGS. 1 and 2. FIG. 1 shows a whole structure of the polishing apparatus. The polishing apparatus has a turntable 1 and a top ring 3 positioned above the turntable 1 for holding a semiconductor wafer 2 and pressing the semiconductor wafer 2 against the turntable 1. The top ring 3 has a holding surface at a lower surface thereof. The turntable 1 is rotatable about its own axis as indicated by the arrow by a motor (not shown) which is coupled through a shaft to the turntable 1. An abrasive cloth 4 is attached to an upper surface of the turntable 1.

The top ring 3 is coupled to a motor (not shown) and also to an air cylinder (not shown). The top ring 3 is vertically movable and rotatable about its own axis as indicated by the arrows by the motor and the air cylinder. The top ring 3 can therefore press the semiconductor wafer 2 against the abrasive cloth 4 under a desired pressure. A guide ring 6 is mounted on the outer circumferential edge of the lower surface of the top ring 3 for preventing the semiconductor wafer 2 from being disengaged from the holding surface of the top ring 3.

An abrasive solution supply nozzle 5 is disposed directly above the turntable 1 for supplying an abrasive solution Q containing abrasive grains onto the abrasive cloth 4 mounted on the turntable 1.

The polishing apparatus operates as follows: The semiconductor wafer 2 is held on the holding surface of the top ring 3, and pressed against the abrasive cloth 4 on the upper surface of the turntable 1 which is being rotated, by the air cylinder. The abrasive solution supply nozzle 5 supplies the abrasive solution Q onto the abrasive cloth 4, and the supplied abrasive solution Q is retained on the abrasive cloth 4. The lower surface of the semiconductor wafer 2 is polished in such a state that the abrasive solution Q is being present between the lower surface of the semiconductor wafer 2 and the abrasive cloth 4.

The polishing apparatus has a dressing head 8 which is positioned at the opposite side of the top ring 3. The dressing head 8 can perform a dressing operation simultaneously with the polishing operation. A nozzle 9 is provided above the abrasive cloth 4 to supply a dressing liquid such as water onto the abrasive cloth 4. The dressing head 8 is coupled to an air cylinder (not shown) and a motor (not shown). Thus, the dressing head 8 is vertically movable and rotatable about its own axis as indicated by the arrows by the air cylinder and the motor. The dressing head 8 has a brush 8*a* for dressing at its lower end.

In the case where a polishing operation and a dressing operation are carried out simultaneously, the abrasive solution and the dressing liquid such as water are supplied simultaneously onto the abrasive cloth 4 from the respective nozzle 5 and 9. However, when the dressing liquid such as water flows into a polishing area in which the top ring 3 is located, the abrasive solution may be diluted with the dressing liquid such as water, thus weakening the polishing action of the abrasive solution. Also, the effect of the dressing for washing away the abrasive solution from the abrasive cloth 4 is lowered.

In order to eliminate the above disadvantages, partition members 10A and 10B are provided to partition a polishing surface of the abrasive cloth 4 into a polishing area PA and a dressing area DA as shown in FIG. 1. The partition members 10A and 10B constitute a partition wall and extend in a radial direction of the turntable 1. The partition members 10A and 10B are fixed to a frame 11. The partition member 10A serves to prevent the abrasive solution from entering the dressing area DA, and the partition member 10B serves to prevent the dressing liquid such as water from entering the polishing area PA. The partition members 10A and 10B contact an upper surface of the abrasive cloth 4, respectively. The abrasive solution is forced to flow out of the turntable 1 by the partition member 10A, and the dressing liquid is forced to flow out of the turntable 1 by the partition member 10B.

By providing the partition members 10A and 10B, little or no mixture of the abrasive solution and the dressing liquid such as water takes place. Consequently, a polishing operation and a dressing operation can be independently carried out without affecting with each other.

The abrasive solution is supplied to the polishing area PA, and the dressing liquid is supplied to the dressing area DA. The partition members 10A and 10B are disposed on the abrasive cloth 4 and comprise a bar-like member, respectively, having a simple structure. The partition members 10A and 10B may comprise a plate-like member, respectively. The position and the number of the partition members are properly selected in accordance with the number of top rings and the rotational speed of the turntable. In FIG. 1, circles shown by broken lines indicate top rings 3 which will be provided additionally. In the case where a plurality of top rings are provided as shown in FIG. 1, the nozzle 5 is moved toward the upstream side in the rotational direction of the turntable 1 and positioned between the partition member 10B and the top ring 3 shown by the broken line.

Further, a gutter 12 for recovering abrasive solution and a gutter 13 for recovering dressing liquid are provided around the turntable 1. That is, the abrasive solution is recovered by the gutter 12, the dressing liquid is recovered by the gutter 13, and the recovered abrasive solution and the recovered dressing liquid are treated independently. The waste liquid of the abrasive solution may contain a small amount of dressing liquid, and the waste liquid of the dressing liquid may contain a small amount of abrasive solution. However, it is more effective to treat the abrasive solution and the dressing liquid discretely because their property and concentration are different from each other.

Further, in the case where the abrasive solution is reused, it is effective to recover the abrasive solution and the dressing liquid separately.

As is apparent from the above description, the present invention offers the following advantages.

(1) A workpiece such as a semiconductor wafer can be polished while removing an abrasive solution and ground-off particles of the workpiece from a polishing surface of the abrasive cloth and regenerating the abrasive cloth. Therefore, the workpiece can be polished in a good polishing condition throughout the whole polishing time.

(2) It is not necessary to perform a dressing operation in between polishing operations, thus increasing the throughput of the workpieces.

(3) Since a partition wall is provided to partition a surface of the abrasive cloth into a polishing area and a dressing area, an abrasive solution for use in polishing and a dressing liquid for use in dressing are not mixed with each other, and a polishing operation and a dressing operation do not interfere with each other.

Although a certain preferred embodiment of the present invention has been shown and described in detail, it should be understood that various changes and modifications may be made therein without departing from the scope of the appended claims.

What is claimed is:

1. An apparatus for polishing a workpiece, comprising:

a turntable with an abrasive cloth mounted on an upper surface thereof;

a top ring disposed above said turntable and having a holding surface for holding a workpiece to be polished and pressing the workpiece against said abrasive cloth;

a dressing head for dressing said abrasive cloth provided at a location away from said top ring;

a partition wall for partitioning a surface of said abrasive cloth into a polishing area in which said top ring is operated and a dressing area in which said dressing head is operated;

a nozzle for supplying an abrasive solution onto said polishing area on said abrasive cloth; and a nozzle for supplying a dressing liquid onto said dressing area on said abrasive cloth.

2. An apparatus according to claim 1, wherein said partition wall comprises two partition members, one of which prevents the abrasive solution from entering said dressing area, the other of which prevents the dressing liquid from entering said polishing area.

3. An apparatus according to claim 2, wherein said partition members are provided away from each other and extend in a radial direction of said turntable.

4. An apparatus according to claim 3, wherein said partition member is an elongated member.

5. An apparatus according to claim 1, further comprising a gutter for recovering the abrasive solution and a gutter for recovering the dressing liquid, said gutters being disposed around said turntable.

6. A method for polishing a workpiece, comprising the steps of:

holding a workpiece by a top ring;

polishing a surface of the workpiece by pressing the workpiece against an abrasive cloth mounted on a turntable while applying an abrasive solution onto said abrasive cloth; and dressing a surface of said abrasive cloth while applying a dressing liquid onto said abrasive cloth during polishing in such a state that the abrasive solution and the dressing liquid do not interfere with each other.

7. A method according to claim 6, wherein interference of the abrasive solution and the dressing liquid is prevented by a partition wall which partitions a surface of said abrasive cloth into a polishing area and a dressing area.

* * * * *